US008925404B2

(12) United States Patent
Lees et al.

(10) Patent No.: US 8,925,404 B2
(45) Date of Patent: Jan. 6, 2015

(54) STARTING DEVICE FOR AN INTERNAL COMBUSTION ENGINE

(75) Inventors: Thomas Lees, Moeglingen (DE); Patrick Hallas, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 171 days.

(21) Appl. No.: 13/520,286

(22) PCT Filed: Nov. 25, 2010

(86) PCT No.: PCT/EP2010/068191

§ 371 (c)(1),
(2), (4) Date: Oct. 1, 2012

(87) PCT Pub. No.: WO2011/080014

PCT Pub. Date: Jul. 7, 2011

(65) Prior Publication Data

US 2013/0008277 A1 Jan. 10, 2013

(30) Foreign Application Priority Data

Dec. 30, 2009 (DE) ..... 10 2009 060 957

(51) Int. Cl.

| | |
|---|---|
| ***F02N 15/06*** | (2006.01) |
| ***F02N 15/00*** | (2006.01) |
| ***F02N 15/04*** | (2006.01) |
| *F02N 15/02* | (2006.01) |

(52) U.S. Cl.

CPC ..... *F02N 15/065* (2013.01); *F02N 15/023* (2013.01); *F02N 15/067* (2013.01); *F02N 2015/061* (2013.01)

USPC ..... 74/7 A; 74/6

(58) Field of Classification Search

CPC ..... F02N 15/06; F02N 11/00; F02N 15/022; F02N 15/065

USPC ..... 74/6, 7 A, 7 R

See application file for complete search history.

(56) References Cited

U.S. PATENT DOCUMENTS

| | | | | | |
|---|---|---|---|---|---|
| 1,575,918 | A | * | 3/1926 | Huntley | 74/7 R |
| 2,070,277 | A | * | 2/1937 | Johnson | 74/7 R |
| 2,333,765 | A | * | 11/1943 | Orlando | 290/38 A |
| 2,420,288 | A | * | 5/1947 | Miller | 74/7 R |
| 2,420,289 | A | * | 5/1947 | Miller | 74/7 R |
| 2,571,018 | A | * | 10/1951 | Digby | 74/7 R |
| 2,595,802 | A | * | 5/1952 | Miller | 74/7 R |

(Continued)

FOREIGN PATENT DOCUMENTS

| | | |
|---|---|---|
| DE | 19802418 | 8/1998 |
| DE | 102005057532 | 7/2006 |

(Continued)

OTHER PUBLICATIONS

PCT/EP2010/068191 International Search Report dated Feb. 11, 2011 (Translation and Original, 8 pages).

*Primary Examiner* — Justin Krause

(74) *Attorney, Agent, or Firm* — Michael Best & Friedrich LLP

(57) ABSTRACT

The invention relates to a starting device for an internal combustion engine, having a hollow shaft (34), a pinion element (43), which comprises a pinion shank (37) having a shank axis (46) in a displacement direction of the pinion shank (37), wherein the pinion shank (37) is inserted in the hollow shaft (34), characterized in that an axial movement of the pinion shank (37) relative to the hollow shaft (34) is limited by a securing element (76), which is secured in the hollow shaft (34) directly or indirectly by an press fit.

5 Claims, 3 Drawing Sheets

(56) References Cited

U.S. PATENT DOCUMENTS

| | | | | |
|---|---|---|---|---|
| 2,787,910 | A * | 4/1957 | Sabatini | 74/7 R |
| 5,513,540 | A | 5/1996 | Giometti | |

FOREIGN PATENT DOCUMENTS

| | | |
|---|---|---|
| FR | 2572137 | 4/1986 |
| GB | 176114 | 2/1922 |
| GB | 755594 | 8/1956 |
| JP | 55-50376 | 11/1980 |
| JP | 57005361 | 1/1982 |
| JP | 59032670 | 2/1984 |
| JP | 59113256 | 6/1984 |
| JP | 2000289572 | 10/2000 |
| JP | 2006200583 | 8/2006 |

* cited by examiner

STARTING DEVICE FOR AN INTERNAL COMBUSTION ENGINE

BACKGROUND OF THE INVENTION

A starting device for an internal combustion engine is known from the German patent publication DE 198 02 418 A1. In the starting device, a securing element is disposed in a hollow shaft, which is part of an outer part of a free wheel. This has the disadvantage that the securing element can potentially wear as a result of rotatory and also translational relative motion between the outer part and said securing element and thereby jump out of a groove. Said securing element does not work then anymore.

SUMMARY OF THE INVENTION

The starting device of the invention has the advantage that the relative motion between the hollow shaft and the pinion shank is limited and therefore wear to the securing element can be considerably reduced.

BRIEF DESCRIPTION OF THE DRAWINGS

In the figures subsequently shown, the invention is depicted in detail in a plurality of examples.

DETAILED DESCRIPTION

Figure 1:
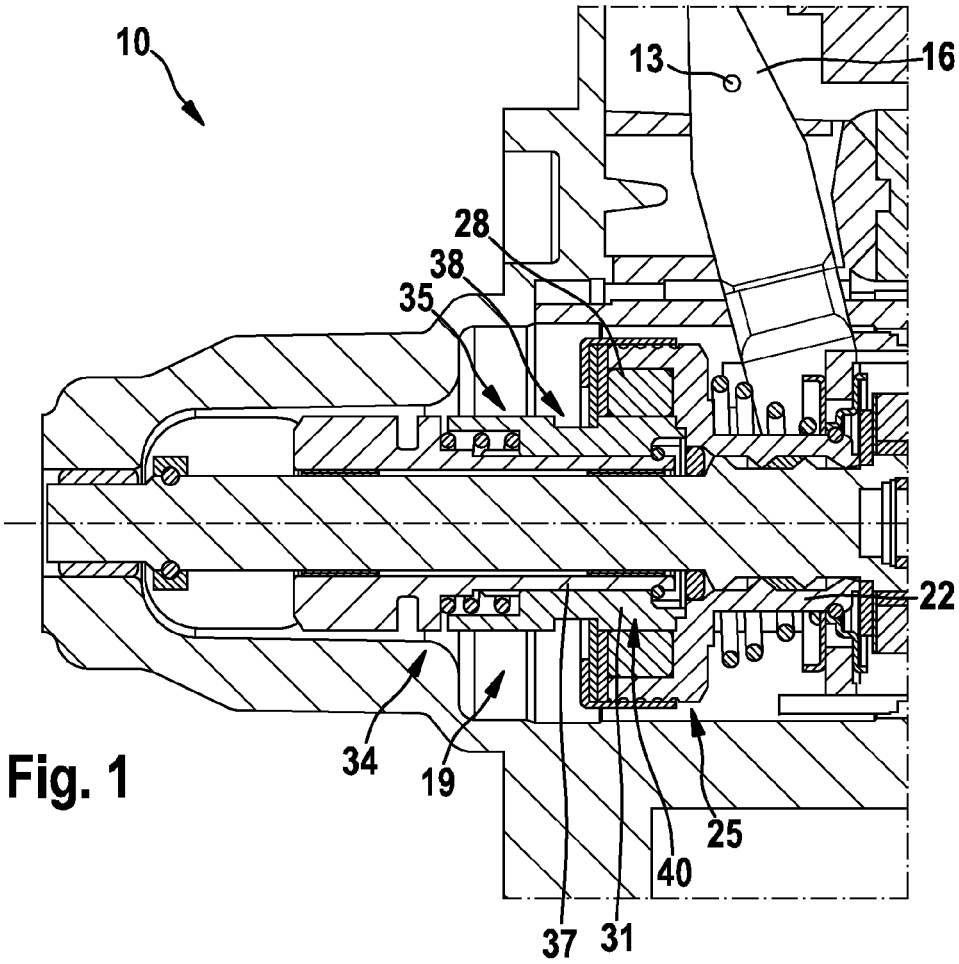
FIG. 1 shows a partial longitudinal section through a starting device of a first exemplary embodiment.

A partial longitudinal section through a starting device 10 is shown schematically in FIG. 1. A fork lever 16 pivotable about a center of rotation 13 is present in a known way, which engages at an end of a pinion-engaging drive 19 that faces an electric starter motor. The pinion-engaging drive 19 in the figure can be moved by means of a pivoting motion to the left to a non-depicted toothed flywheel ring of the internal combustion engine.

The parts of the pinion-engaging drive 19 are a driving element 22 of a free wheel 25 comprising clamping rolls 28 and an inner ring 31, which is part of a hollow shaft 34. The hollow shaft 34 comprising an internal straight toothing on the inner circumference thereof forms with a pinion shank 37 and the external straight toothing 38 thereof a shaft-hub connection 40, which, for example, is embodied as a straight-toothed splined-shaft connection. The pinion shank 37 slides on a pinion shaft 43 during a forward or backward movement of the pinion-engaging drive 19.

Figure 2:
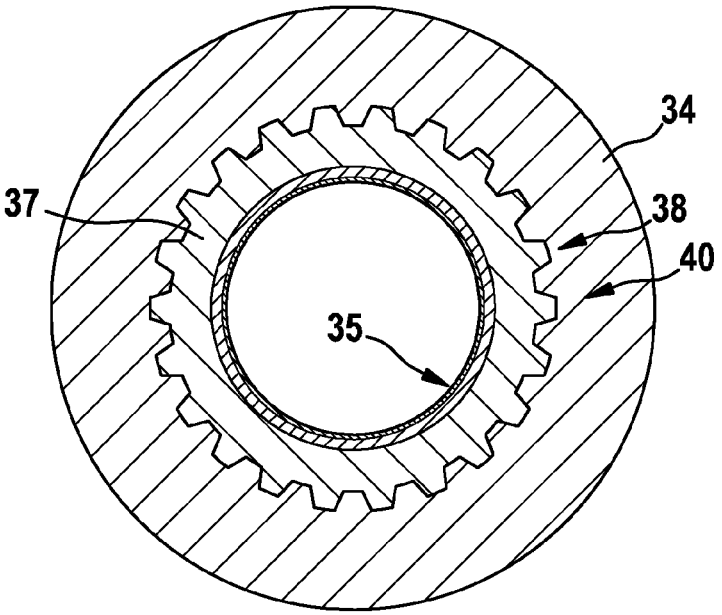
FIG. 2 shows a cross section through a hollow shaft of the first exemplary embodiment.

In FIG. 2, a cross section through the hollow shaft and the pinion shank 37 is depicted. The shaft-hub connection 40 comprising the internal straight toothing 35 and the external straight toothing 38 can be easily recognized.

Figure 3:
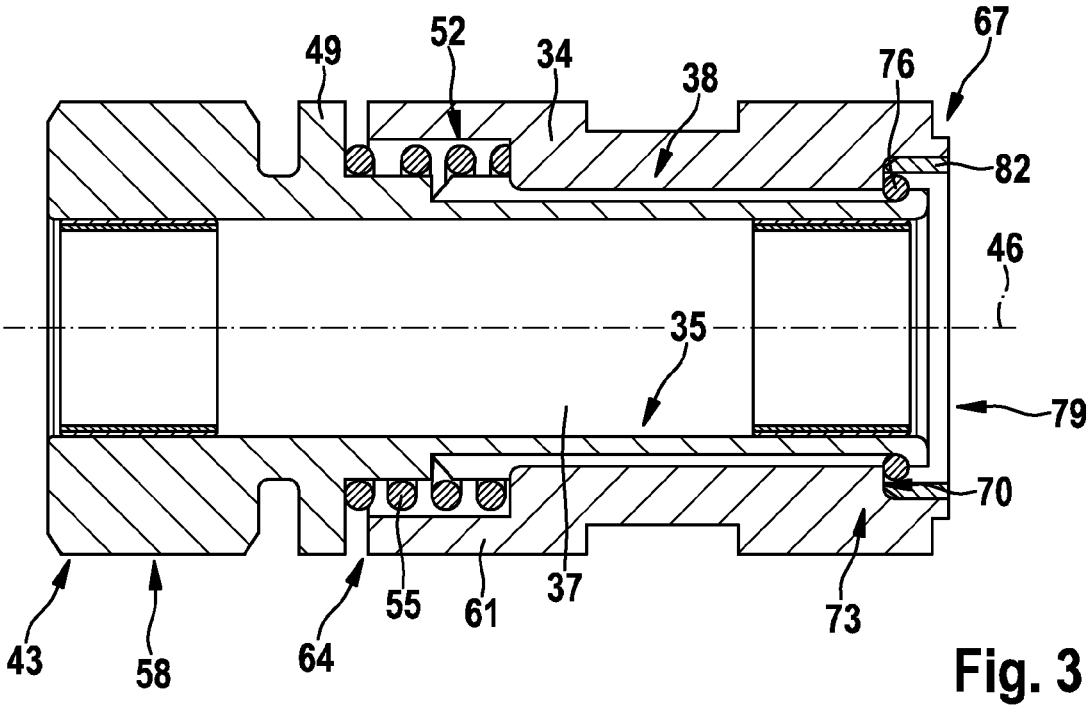
FIG. 3 shows and enlarged view of the hollow shaft and the pinion shank of the first exemplary embodiment.

FIG. 3 shows the hollow shaft 34 with a pinion element 43, which comprises a pinion shank 37 having a shank axis 46 in a displacement direction of the pinion shank 37. Said pinion shank 37 is inserted in said hollow shaft 34. A spring 55, which is configured as a spiral spring, is disposed between a collar 49 and an abutting face 52. In this way, the pinion element 43 and said hollow shaft 34 are supported resiliently against each other. A section 61 of said hollow shaft 34 oriented towards a pinion 58 projects over the spring 55 and thus protects the same. Said section also serves with an end 64 facing the collar 49 as a stop for said collar 49 when the pinion 58 rests against the toothed flywheel ring (tooth against tooth position).

On the end 67 of the hollow shaft 34 facing away from the pinion 58, said hollow shaft 34 has an end face 70 facing away from the pinion element 43. The pinion shank 37 leaves said hollow shaft 34 behind the end face 70. Between one end of the pinion shank 37 and the end face 70, said pinion shank 37 has a circumferential groove 73, in which a securing element 76 sits, which is indirectly secured and is designed as a circlip. Said hollow shaft 34 has a cylindrical widening 79 radially outside the securing element 76, said widening extending to the end of said hollow shaft 34. The indirect securing of the securing element is achieved by virtue of the fact that as a means for securing said securing element 76, a bushing 82 is disposed radially outside of said securing element 76. The bushing 82, which is press fit in said hollow shaft 34, protects said securing element 76 from inadmissible expansion under a centrifugal force load. The assembly consisting of hollow shaft 34 and pinion shank 37 thereby also remains intact at high rotational speeds.

An axial movement of the pinion shank 37 relative to the hollow shaft 34 is limited by the securing element 76, which is secured in the hollow shaft indirectly by a press fit (of the bushing 82).

Figure 4:
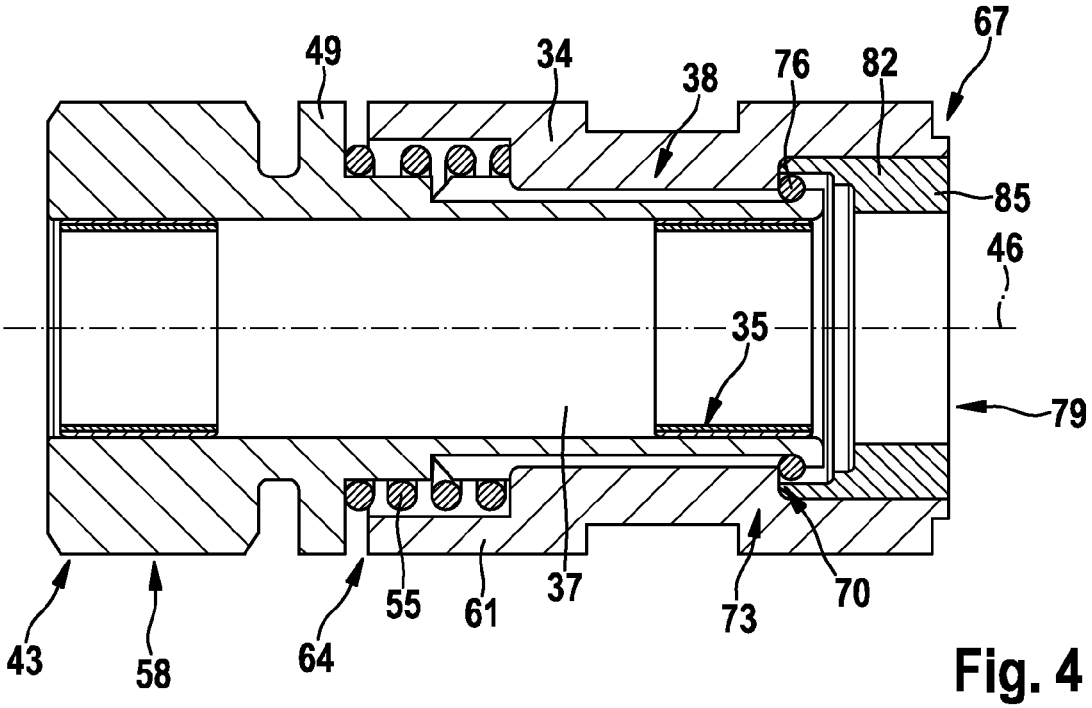
FIG. 4 shows an enlarged view of the hollow shaft and the pinion shank of a second exemplary embodiment.

The substantial modification or respectively deviation of the second exemplary embodiment pursuant to FIG. 4 with respect to the first exemplary embodiment is that the bushing 82 has a section that undercuts the securing element 76. A larger radial material thickness of said bushing 82 inevitably results by means of this undercut. A direct consequence thereof is a support of the hollow shaft 34 so as to strengthen the same in this region. The load capacity of the inner ring 31, which is a part of the hollow shaft 34, is thereby higher for clamping forces of the free wheel 25.

A still higher load capacity results pursuant to FIG. 4 from the fact that the bushing 82 has a section, which is directly opposite of the pinion shank 37.

Figure 5:
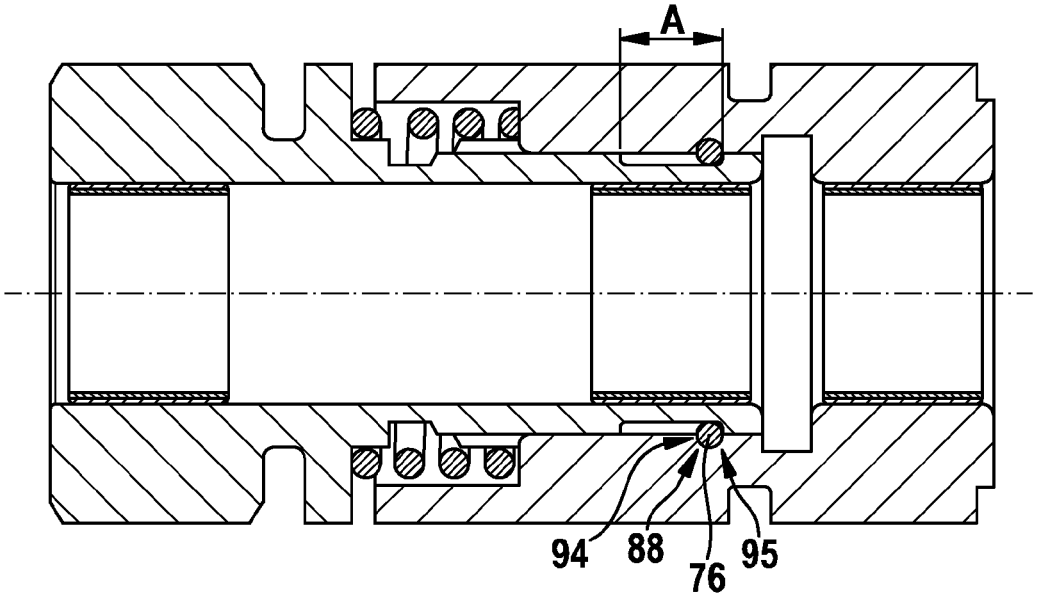
FIG. 5 shows an enlarged view of the hollow shaft and the pinion shank of a third exemplary embodiment.
Figure 6:
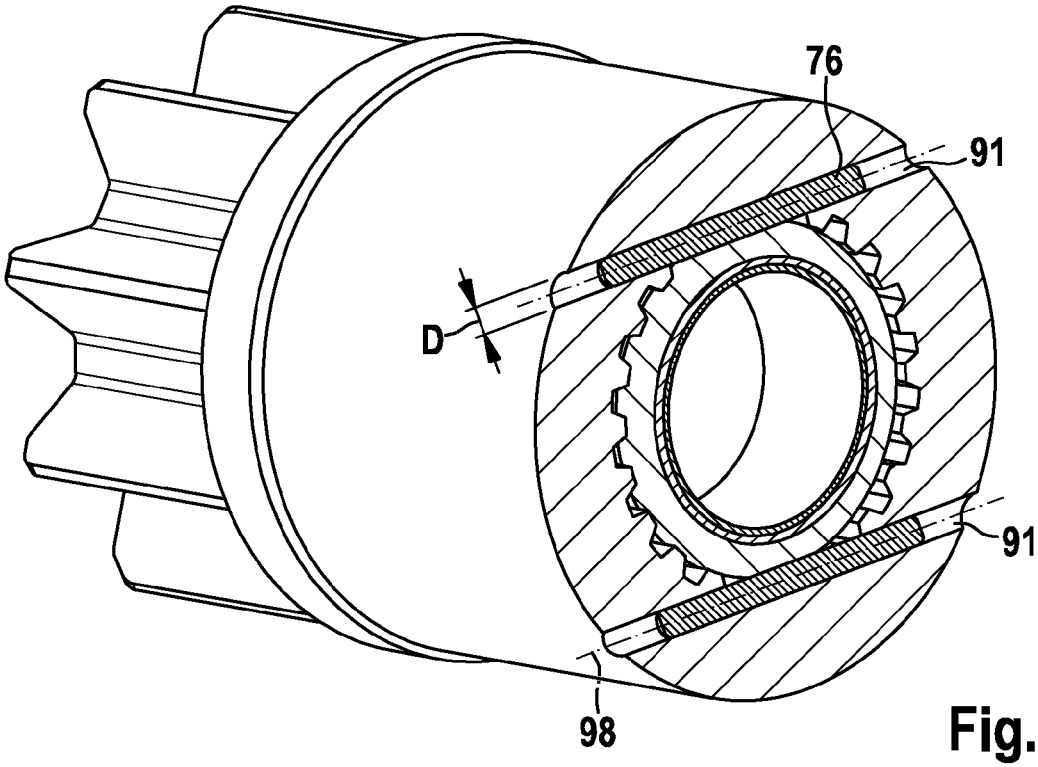
FIG. 6 shows and enlarged view of the hollow shaft and the pinion shank of the third exemplary embodiment in cross section.

The third exemplary embodiment is shown in FIGS. 5 and 6. The hollow shaft 34 again in this case receives the pinion shank 37. The pinion shank 37 is protected here from falling out by said pinion shank 37 comprising a groove 88 (circumferential annular groove or tangential groove). A securing element 76, in this case designed as a pin, engages in the groove 88 and thus an excessive displacement of the pinion shank 37 with respect to the hollow shaft 34 is prevented. The pinion shank 37 is inserted in the hollow shaft 34 and an axial movement of said pinion shank 37 relative to said hollow shaft 34 is limited by a securing element 76, which is secured in said hollow shaft 34 directly by a press fit. A tangential bore 91 is incorporated in said hollow shaft 34 and the pin is pressed into said bore with an interference fit. The pin thus also sits in the groove 88.

The securing element 76 which is secured so directly is at least one pin. In FIGS. 5 and 6, there are in each case two bores 91 and two pins, which engage in a respective tangential groove 88. As an alternative, it would also be an option to use a circumferential groove 88 for both pins. Both pins are parallel to one another.

The groove 88 has in each case two flanks 94 and 95, which delimit said groove 88. The at least one pin engages in a groove 88 comprising flanks 94, 95, wherein pursuant to FIGS. 5 and 6, the pin has a longitudinal axis 98, which is oriented parallel to the flanks 94, 95

A distance A between the flanks 94, 95 is larger than a diameter D of the pin.

The invention claimed is:

1. A starting device for an internal combustion engine, the device comprising a hollow shaft (34), and a pinion element (43), which comprises a pinion shank (37) having a shank axis (46) in a displacement direction of the pinion shank (37), wherein said pinion shank (37) is inserted in the hollow shaft (34), characterized in that an axial movement of said pinion shank (37) relative to said hollow shaft (34) is limited by a securing element (76), which is secured in said hollow shaft (34) directly by a press fit, further characterized in that the securing element (76) is at least one pin which engages in a groove (88) comprising flanks (94, 95), wherein the pin has a longitudinal axis, which is oriented parallel to the flanks (94, 95).

2. The starting device according to claim 1, characterized in that a distance (A) between the flanks (94, 95) is larger than a diameter (D) of the pin.

3. A starting device for an internal combustion engine, the device comprising a hollow shaft (34), and a pinion element (43), which comprises a pinion shank (37) having a shank axis (46) in a displacement direction of the pinion shank (37), wherein said pinion shank (37) is inserted in the hollow shaft (34), characterized in that an axial movement of said pinion shank (37) relative to said hollow shaft (34) is limited by a securing element (76), which is secured in said hollow shaft (34) directly or indirectly by a press fit, and further characterized in that the hollow shaft (34) has an end face (70) facing away from the pinion element (43), the pinion shank (37) leaves said hollow shaft (34) behind an end face (70) and the securing element (76), which is indirectly secured, is secured against inadmissible expansion by a bushing (82) which is disposed radially outside of said securing element (76) and is press fit in said hollow shaft (34).

4. The starting device according to claim 3, characterized in that the bushing (82) has a section (85) which undercuts the securing element (76).

5. The starting device according to claim 4, characterized in that the bushing (82) has a section (85) which is located directly opposite the pinion shank (37).

* * * * *